US006883197B2

(12) United States Patent
Tak

(10) Patent No.: US 6,883,197 B2
(45) Date of Patent: Apr. 26, 2005

(54) SHOE CORRECTOR

(75) Inventor: Seung-Ho Tak, Seoul (KR)

(73) Assignee: SHT Co., Ltd.., Seoul (KR)

( * ) Notice: Subject to any disclaimer, the term of this patent is extended or adjusted under 35 U.S.C. 154(b) by 0 days.

(21) Appl. No.: 10/169,000

(22) PCT Filed: Dec. 26, 2000

(86) PCT No.: PCT/KR00/01534

§ 371 (c)(1),
(2), (4) Date: Oct. 11, 2002

(87) PCT Pub. No.: WO01/47388

PCT Pub. Date: Jul. 5, 2001

(65) Prior Publication Data

US 2003/0041394 A1 Mar. 6, 2003

(30) Foreign Application Priority Data

Dec. 27, 1999 (KR) ..... 1999-62792

(51) Int. Cl.[7] ..... A43D 3/14
(52) U.S. Cl. ..... 12/115.8; 12/116.2; 12/117.4
(58) Field of Search ..... 12/115.2, 115.8, 12/116.2, 116.8, 117.4, 115.6

(56) References Cited

U.S. PATENT DOCUMENTS

| | | | | | |
|---|---|---|---|---|---|
| 229,156 | A | * | 6/1880 | Lyons | 12/115.2 |
| 887,214 | A | * | 5/1908 | Monroe | 12/115.2 |
| 986,680 | A | * | 3/1911 | Bowen | 12/115.8 |
| 1,387,516 | A | * | 8/1921 | Schulz | 12/115.2 |
| 1,660,912 | A | * | 2/1928 | Brock et al. | 12/116.2 |
| 1,753,857 | A | * | 4/1930 | Galterio et al. | 12/116.2 |
| 1,936,399 | A | * | 11/1933 | La Marca | 12/115.2 |
| 2,010,146 | A | * | 8/1935 | Garson | 12/115.2 |
| 2,068,232 | A | * | 1/1937 | Gershune | 12/117.4 |
| 2,070,234 | A | * | 2/1937 | Loeffler | 12/115.2 |
| 2,155,015 | A | | 4/1939 | Jones | |
| 2,303,469 | A | * | 12/1942 | Janic | 12/115.6 |
| 3,860,986 | A | | 1/1975 | Ballard | |
| 3,877,100 | A | * | 4/1975 | Harvey | 12/115.2 |
| 4,512,052 | A | * | 4/1985 | Bruno | 12/116.2 |
| 4,554,694 | A | | 11/1985 | Tradigo | |
| 4,718,135 | A | | 1/1988 | Colvin | |
| 5,659,913 | A | * | 8/1997 | Toscanini et al. | 12/135 A |

FOREIGN PATENT DOCUMENTS

| | | |
|---|---|---|
| DE | 3431904 | 3/1986 |
| GB | 583659 | 12/1946 |

* cited by examiner

*Primary Examiner*—Ted Kavanaugh
(74) *Attorney, Agent, or Firm*—Lowe Hauptman & Berner, LLP

(57) ABSTRACT

A shoe corrector for correcting the shape of a shoe such that it completely fits a wearer's foot and making the interior space dry and clean is provided. The shoe corrector allows each individual's foot to be accustomed to shoes which are mass produced with standardized dimensions thus providing more comfort to the wearer. Furthermore, the shoe corrector prevents the shoe from deforming with long use.

4 Claims, 5 Drawing Sheets

SHOE CORRECTOR

BACKGROUND OF THE INVENTION

1. Field of the Invention

The present invention relates to a shoe corrector, and more particularly, to a shoe corrector for correcting the shape of a shoe such that it completely fits a wearer's foot and making the interior space dry and clean.

2. Description of the Related Art

Each individual's foot takes slightly different forms for differences in one's living environments or genetic factors. Formerly, shoes were custom tailored to conform to and fit each individual's foot. However, in recent days, due to an increase in population and industrialization, commercially manufactured shoes which are mass produced in stock sizes have been available to the greatest number of persons.

Typically, shoes in mass production are manufactured without any specific consideration of the shape or configuration of a wearer's foot. Thus, it is difficult to obtain a shoe completely fitted to the particular foot, even if a shoe fitted to the wearer's foot is selected. For this reason, many people who wear new shoes may have a blister or pain on their feet. High quality shoes made of soft and flexible leather can only alleviate such problems, not completely eliminate them. If the shoe is not well fitted to the wearer's foot, the foot suffers from weariness and hardened skin. Also, wearing shoes for long hours creates problems in sanitation such as the propagation of germs in the inner area of the shoe due to the wearer's foot perspiring. For example, in rainy or snowy days, the above problems go from bad to worse because a substantial amount of moisture is permeable.

SUMMARY OF THE INVENTION

To solve the above-described problems, it is an object of the present invention to provide it is an object of the present invention to provide a shoe corrector for correcting the shape of a shoe such that the shoe completely fits a wearer's foot thus providing comfort to the wearer and for making the interior space in wet and dirty conditions dry and clean by preventing the propagation of germs caused by the wearer's foot perspiring.

To accomplish the above object, the present invention provides a shoe corrector installed within a shoe for stretching a shoe upper leather so that the shape of the shoe fits a wearer's foot. The shoe corrector includes: a front mold for outwardly exerting elastic pressure on the shoe upper leather which contacts the top side and toes of the shoe; a back mold disposed in the rear of the front mold for outwardly exerting elastic pressure on the shoe upper leather which contacts the heel of the shoe; and a length controller for connecting the front mold with the back mold and adjusting the distance between the front and back molds.

The back mold comprises a pressure wall facing the front mold, at which a horizontal through hole is formed. The length controller includes: a connecting rod penetrating the through hole, the front end of which is combined with the front mold; a control lever, pin connected to the back mold such that the control lever can turn on a pin, for controlling the distance between the front and back molds by moving the connecting rod in a longitudinal direction; and a spring provided between the front mold and the pressure wall for elastically separating the back mold from the front mold.

Preferably, the front mold includes: a pressing plate which moves upward from the upper surface of the front mold; an elastic means for elastically supporting the pressing plate; and a control screw screwed to the front mold by penetrating the pressing plate for controlling an angle at which the pressing plate moves from the surface of the front mold. In this case, the pressing plate, the elastic means, and the control screw are disposed on the upper surface of the front mold for upwardly exerting pressure on the upper leather corresponding to the top side of the shoe.

Preferably, the front mold includes a plurality of receiving grooves disposed at the side of the front mold, in each of which a female screw is formed; a pressure member disposed within each of the plurality of receiving grooves; an elastic means for elastically supporting the pressure member; and a control screw inserted into the female screw by penetrating the pressure member for controlling the projection of the pressure member. In this case, the receiving groove, the pressure member, the elastic means, and the control screw are disposed at the side of the front mod for outwardly exerting elastic pressure on the upper leather contacting the toes of the shoe.

Preferably, the back mold includes a receiving groove disposed on the outer surface of the rear end of the back mold, in which a female screw is formed; a pressing plate disposed in the receiving groove; an elastic means for elastically supporting the pressing plate in an outward direction; and a control screw inserted into a female screw by penetrating the pressing plate for controlling an angle at which the pressing plate moves from the surface of the back mold. In this case, the receiving groove, the pressing plate, the elastic means, and the control screw are disposed at the rear end of the back mold for outwardly exerting pressure on the upper leather which contacts the heel of the shoe.

Preferably, the front portion of the front mold up to the pressing plate is vertically cut along a longitudinal direction of the front mold, and a spring is interposed between the cut sections so as to provide elastic pressure on the upper leather in a lateral direction. Furthermore, the front mold includes a mold cavity, and a plurality of ventilating holes are disposed on the front mold such that the interior space of the front mold is connected to the outside.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

The present invention will now be described more fully with reference to the accompanying drawings. Basically, a shoe corrector according to the present invention is a mold fitted to the shape of a wearer's foot, which is mounted in the inner area of a new shoe. The shoe corrector serves to stretch the shoe upper leather such that the shape of the shoe conforms to the shape of the wearer's foot.

Figure 1:
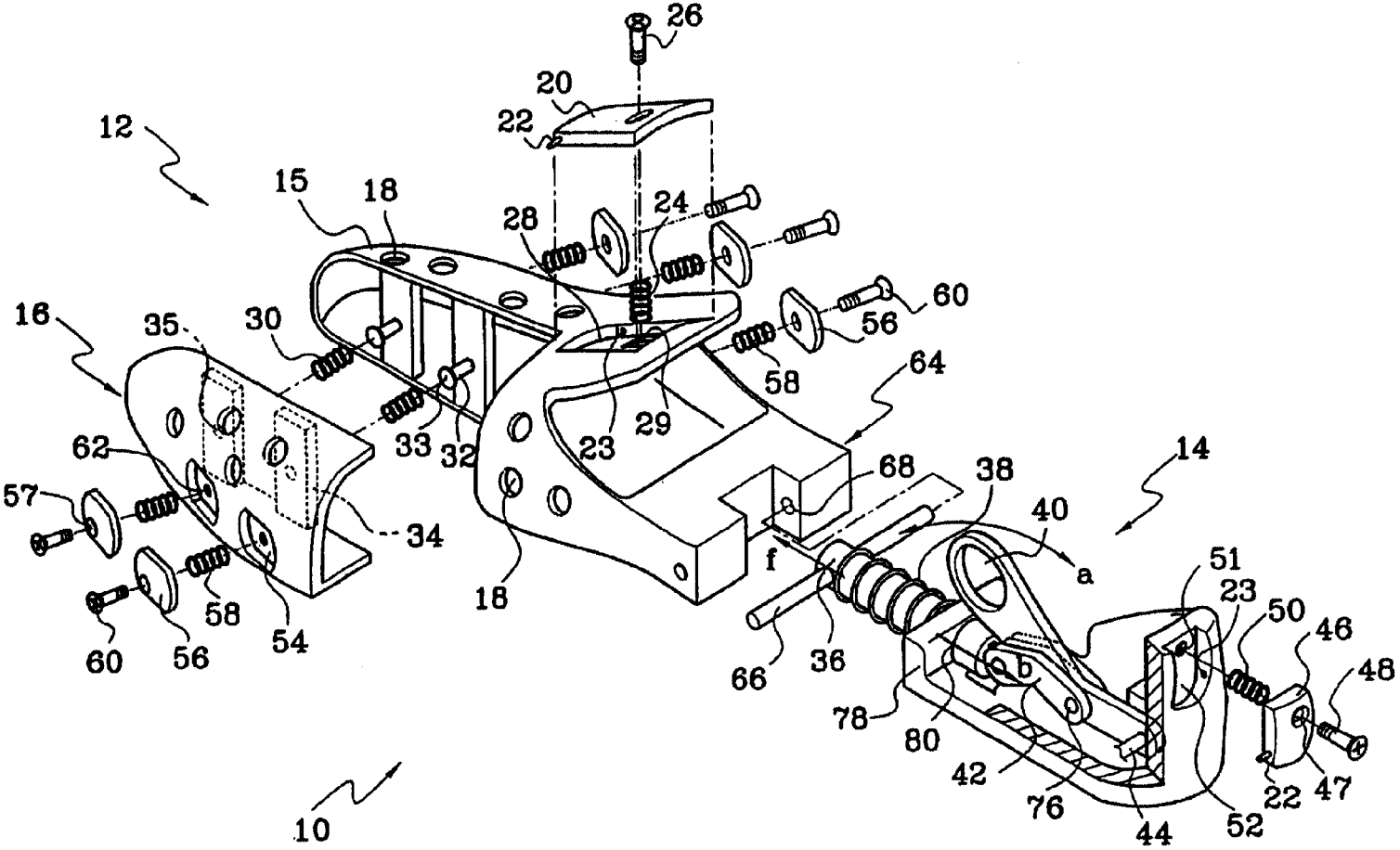
FIG. 1 is an exploded perspective view showing the configuration of a shoe corrector according to an embodiment of the present invention.

FIG. 1 is an exploded perspective view showing the configuration of a shoe corrector according to an embodiment of the present invention. Referring to FIG. 1, the shoe corrector 10 includes a front mold 12, a back mold 14, and a length controller for connecting the front mold 12 with the back mold 14 and adjusting the distance therebetween. The front mold 12, the back mold 14, and a side pressure portion 16, which will be described below, may be made of plastic or wood.

The front mold 12 inserted below the top side of a shoe includes a mold cavity. The front mold 12, which conforms in appearance to the top side of a wearer's foot, is inserted into the inner area of the shoe, thereby exerting pressure on the upper leather. As a result, the shape of the shoe comes to fit the shape of the foot. The front mold 12 also includes a plurality of ventilating holes 18 over the entire surface, the function of which will be described below. The ventilating holes 18 serves as a connection port for connecting the inner area of the front mold 12 with the outside.

A receiving groove 28 is disposed on the upper surface corresponding to the top side of the front mold 12. The receiving groove 28 has an approximately rectangular shape. A female screw 29 is formed on the bottom surface of the receiving groove and pivot insertion holes 23 are formed at both sidewalls. A pressing plate 20 is disposed within the receiving groove 28. The pressing plate 20 pivots upward from the receiving groove 28 thus projecting higher than the outer surface of the front mold 12. The upper surface of the pressing plate 20 is curved to the shape of the top side of the foot. Thus, when the pressing plate 20 is completely inserted into the receiving groove 28, the outer surface of the front mold 12 is streamlined on the whole.

Also, a pivot 22 supported by inserting into the pivot insertion hole 23 is provided at either side of the pressing plate 20, and a screw through hole 25 is disposed at the position corresponding to the screw female 29. The screw through hole 25 is a simple hole for passing through only a screw thread.

A spring 24 is provided between the pressing plate 20 and the receiving groove 28. The spring 24 is supported on the bottom surface of the receiving grove 28 thereby exerting upward elastic pressure on the pressing plate 20. The spring 24 is positioned between the female screw 29 and the screw through hole 25. An angle at which the pressing plate 20 is turned is adjusted by a control screw 26. The control screw 26 which passes through the screw through hole 25 and the spring 24 is inserted in the female screw 29.

Since the pressing plate 20 is elastically supported in an upward direction, the pressing plate 20 moves upward around the pivot 22 when the control screw 26 gets loose. When the control screw 26 gets tight, the pressing plate 20 moves toward the receiving groove. If the turning angle of the pressing plate 20 is greater and the pressing plate 20 projects higher, the pressure exerted on a shoe upper leather increases.

The front portion of the front mold 12, that is, the portion from the front end to the receiving groove 28 is vertically comparted into two parts. Then, the left of the two parts is cut to the left direction as shown in the drawings. The part separated from the main body of the front mold 12 is the side pressure portion 16 for providing pressure to the shoe upper leather in a lateral direction.

The main body 15 of the front mold 12 and the side pressure portion 16 are interconnected by a connecting rod 32 and elastically separated by a spring 30. To this end, the main body of the front mold 12 includes two connecting rods 32 provided in parallel toward the side pressure portion 16. A projection 33 is provided at the end of each connecting rod 32. Also, the side pressure portion 16 includes supports 34, each support 34 having an installment hole 35 in which the corresponding connecting rod 32 is inserted.

The diameter of the installment hole 35 is greater than that of the connecting rod 32 and less than that of the projection 33. Thus, it is possible that the side pressure portion 32 moves back and forth with respect to the main body 15 when connecting rod 32 is inserted in the installation hole 35. Also, the connecting rod 32 is surrounded by the spring 30.

When the connecting rod 32 is inserted into the installation hole 35, the projection 33 is caught on the installation hole 35, so that the connecting rod 32 cannot get away from the installation hole 35. In this case, the spring 30 puts pressure on the support 34 thereby spacing apart the side pressure portion 16 from the main body 15 as much as possible. As the side pressure portion 16 is pressed by external force, the spring 30 contracts so that the main body 15 of the front mold 12 is in contact with the side pressure portion 16.

A plurality of pressure members 56 are provided at the sides of the front mold 12. The pressure member 56 exerts elastic pressure on a shoe upper leather which is in contact with the toes. Like in the pressing plate 20, since the outer surface of the pressure member 56 is curved, the outer surface of the front mold 12 is streamlined when the pressure member 56 is completely inserted into a receiving groove 54 which will be described below.

A plurality of receiving grooves 54 are provided at the sides of the front mold 12 so as to install the pressure members 56. The receiving groove 54 has an approximately rectangular shape, and a female screw is formed on the bottom surface thereof. Also, a spring 58 is interposed between the pressure member 56 inserted into the receiving groove 54 and the bottom surface of the receiving groove 54. The spring 58 applies its elastic pressure biasing the pressure member 56 outward away from receiving groove 54.

The extent to which the pressure member 56 projects out with respect to the outer surface of the front mold 12 is adjusted by a control screw 60. The control screw 60 passes through a screw through hole 57 and the spring 58 to be inserted into the female screw 62. The looser the control screw 60 gets, the more the pressure member 56 projects out. On the other hand, if the control screw 60 is tightened completely, the pressure member 56 is completely inserted into the receiving groove 54.

A connection portion 64 is provided at the rear end of the front mold 12. The connection portion 64 connecting with a connecting rod 36, which will be described below, includes a pin insertion hole 68 for supporting a connection pin 66 of the connecting rod 36.

Meanwhile, the back mold 14 located in the rear of the front mold 12 exerts elastic pressure outwardly on the upper leather corresponding to the heel of the shoe. The back mold 14 includes a pressure wall 78 facing the front mold 12. A through hole 80 is horizontally provided at the center of the pressure wall 78. The through hole 80 for penetrating the connecting rod 36 contacts the circumference of the connecting rod 36 and guides the longitudinal movement of the connecting rod 36.

The connecting rod 36 connects the front mold 12 with the back mold 14, the front end of which is connected to the front mold 12 through a connection pin 66. Also, the rear end of the connecting rod 36 is pin connected to a link member 42. The link member 42 connects to a control lever 40 which will be described later and transports the turning force originating from the control lever 40 to the connecting rod 36.

The circumference of the connecting rod 36 includes a spring 38. The spring 38 is a compression spring, one end of which is supported by the connection pin 66 while the other end is supported by the pressure wall 78. Thus, the connection pin 66 is always elastically supported by the spring 38 in the direction indicated by arrow f.

The control lever 40 is connected by pin 44 to the upper surface of the back mold 14 so that it is turnable in the direction indicated by arrow a. The control lever 40 which is supported by the pin 44 and turned by a user is bent up at an obtuse angle. The link member 42 is connected by pin 76 to the control lever 40 at the bend.

As described above, one end of the link member 42 is pin connected to the connecting rod 36 while the other end is pin 76 connected to the control lever 40. Thus, if the control lever 40 is pulled, the turning force of the control lever 40 is delivered to the connecting rod 36 through the link member 42, which causes the connecting rod 36 to move toward the direction indicated by arrow b. As the connecting rod 36 moves toward the direction indicated by arrow b, the distance between the front and back molds 12 and 14 becomes smaller.

On the other hand, if the control lever 40 is released, the front and back molds 12 and 14 are separated again by elastic recovery tendency of the spring 38, and thus the control lever 40 turns downward.

Meanwhile, a receiving groove 52 is provided on the upper portion of the rear end of the back mold 14. The receiving groove 52 having an approximately rectangular shape is a groove for holding a pressing plate 46. A female screw 51 is formed at the bottom surface of the receiving groove 52, and pivot insertion holes 23 are formed at both inner sidewalls at opposite positions.

A pressing plate 46 is provided within the receiving groove 52. The pressing plate 46 exerts pressure outwardly on the upper leather corresponding to the Achilles tendon of the heel of a shoe. A screw through hole 47 is formed at the substantially central part of the pressing plate 46, and pivots 22 are provided at both sides of the lower portion. Each pivot 22 is inserted into the corresponding pivot insertion hole 23.

A spring 50 is provided between the bottom surface of the receiving groove 52 and the pressing plate 46. The spring 50 located between the female screw 51 and the screw through hole 47 exerts elastic pressure outwardly on the pressing plate 46.

A control screw 48 is provided for controlling the projection angle of the pressing plate 46. The control screw 48 which penetrates the screw through hole 47 and the spring 50 is inserted into the female 51 thereby controlling the turning angle of the pressing plate 46. If the control screw 48 is tightened relatively loose, the pressing plate 46 projects more due to the spring 50.

Figure 2:
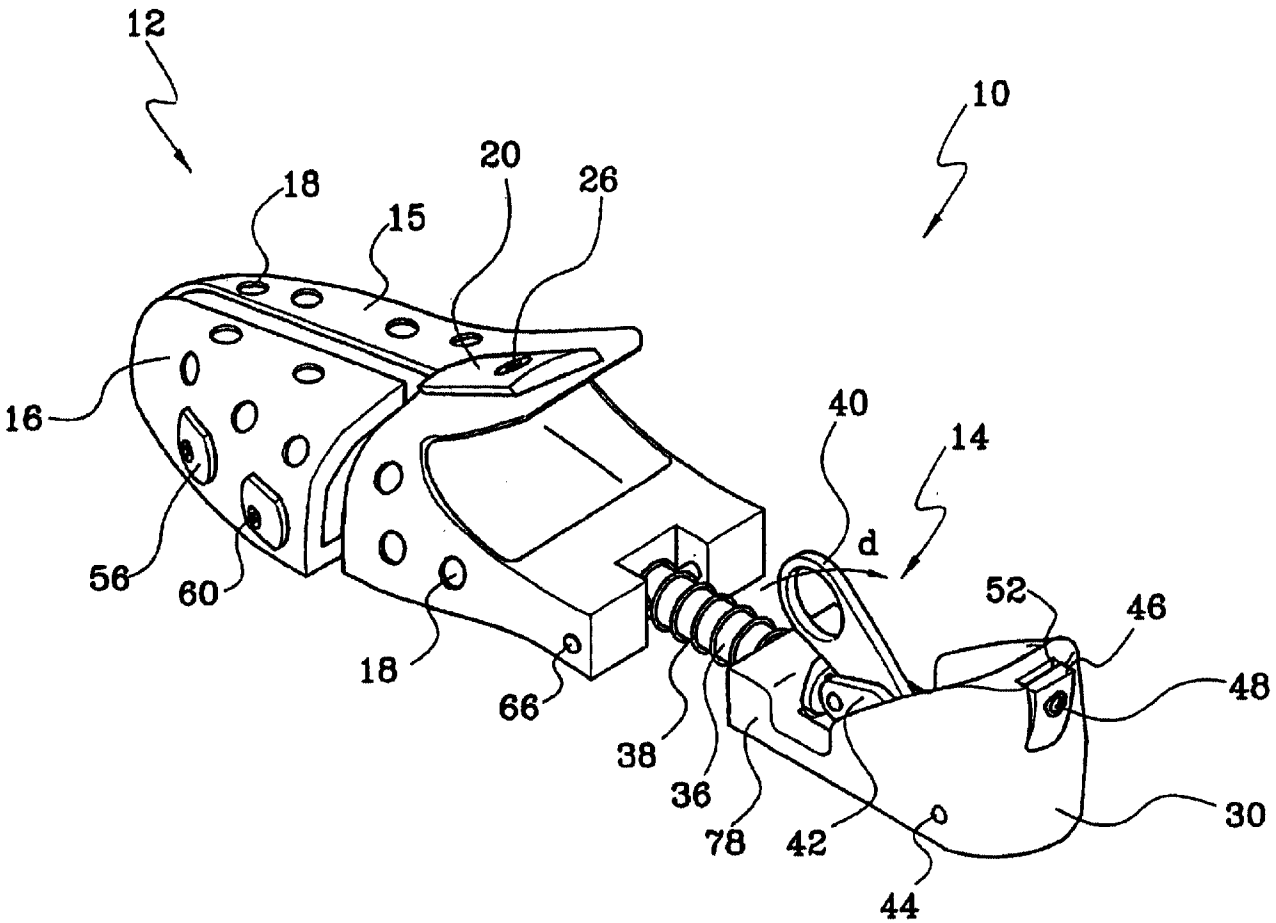
FIG. 2 is a perspective view of a shoe corrector according to an embodiment of the present invention.

FIG. 2 is a perspective view of the shoe corrector according to an embodiment of the present invention. Referring to FIG. 2, the shoe corrector according to the embodiment of the present invention includes the front and back molds 12 and 14, which exerts pressure outwardly on a shoe upper leather. Furthermore, the pressing plate 20 projects out higher than the outer surface of the shoe. The turning angle of the pressing plate 20 is determined depending on the extent to which the control screw 26 is tightened.

Also, the pressure member 56 projects at the side of the front mold 12. As described above, the projection distance of the pressure member 56 is controlled by the control screw 60. Similarly, the pressing plate 46 of the back mold 14 projects out, thus outwardly exerting elastic pressure on the upper leather. The side pressure portion 16 also is separated from the main body 15. This separation of the side pressure portion 16 is maintained by the spring (30 of FIG. 1) described in conjunction with FIG. 1.

The locations of the pressing plate 20, the pressure member 56 and the pressing plate 46 are controlled independently and selectively. That is, their locations are appropriately controlled by the user depending on the particular application.

Meanwhile, the control lever 40 is pulled all the way toward the pressure wall 78 thereby separating the back mold 14 from the front mold as much as possible. In this case, if the corrector 10 is to be inserted into the shoe, the control lever 40 is pulled in the direction indicated by arrow d to narrow the gap between the front and back molds 12 and 14. If the control lever 40 lets loose after positioning the corrector 10 into the shoe, the elastic recovery tendency of the spring 38 outwardly exerts pressure on the shoe upper leather. Also in the side pressure portion 16, the elastic force of the spring (30 of FIG. 1) exerts pressure on the upper leather in a lateral direction.

Figure 3:
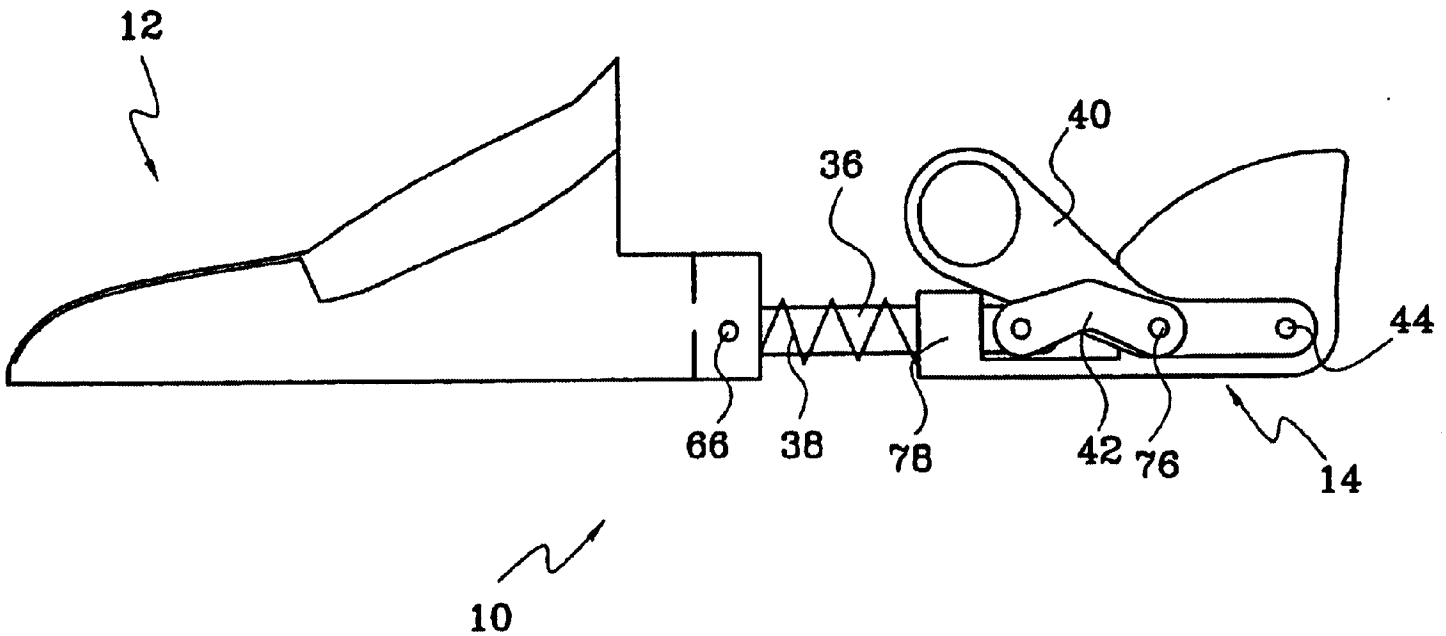
FIGS. 3 and 4 illustrate the operation of the shoe corrector according to an embodiment of the present invention.
Figure 4:
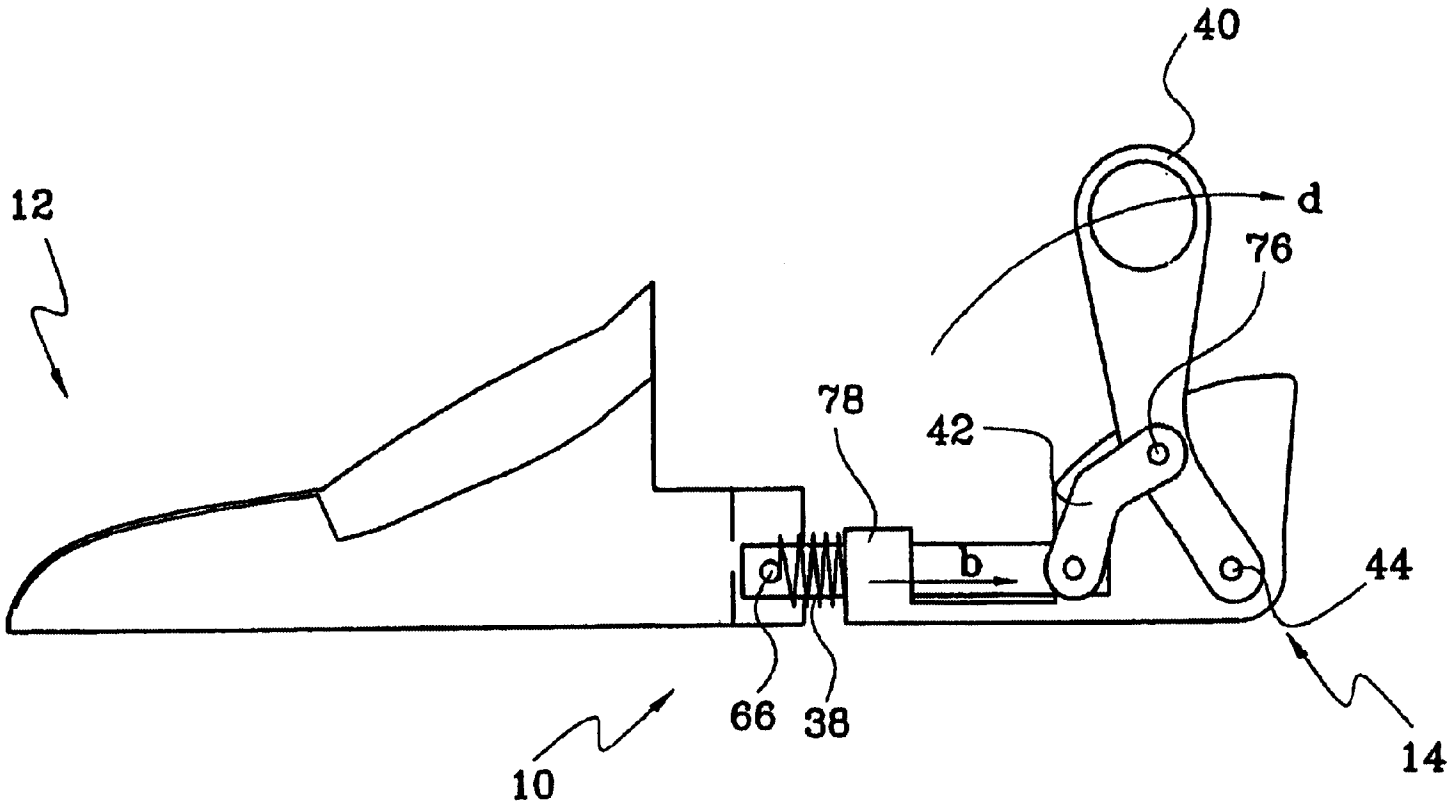

FIGS. 3 and 4 show the operation of the shoe corrector according to an embodiment of the present invention. FIG. 3 shows the state in which external force is not applied to the shoe corrector according to an embodiment of the present invention. Referring to FIG. 3, the front and back molds 12 and 14 are separated to a maximum by the elastic force of the spring 38. Also, the connecting rod 36 is moved as much as possible in the direction indicated by arrow f of FIG. 1, and the control lever 40 is lowered as much as possible.

FIG. 4 shows the state in which the front mold 12 approaches the back mold 14 by turning the control lever 40 upward along the direction indicated by arrow d and thus moving the connecting rod 40 in the direction indicated by arrow b. After the corrector 10 is inserted into the shoe in the state in which the gap between the front and back molds 12 and 14 is made small, when the control lever 40 is released, the elastic recovery force of the spring 38 widens the gap between the front and back molds 12 and 14 thereby outwardly exerting pressure on the upper leather.

Figure 5:
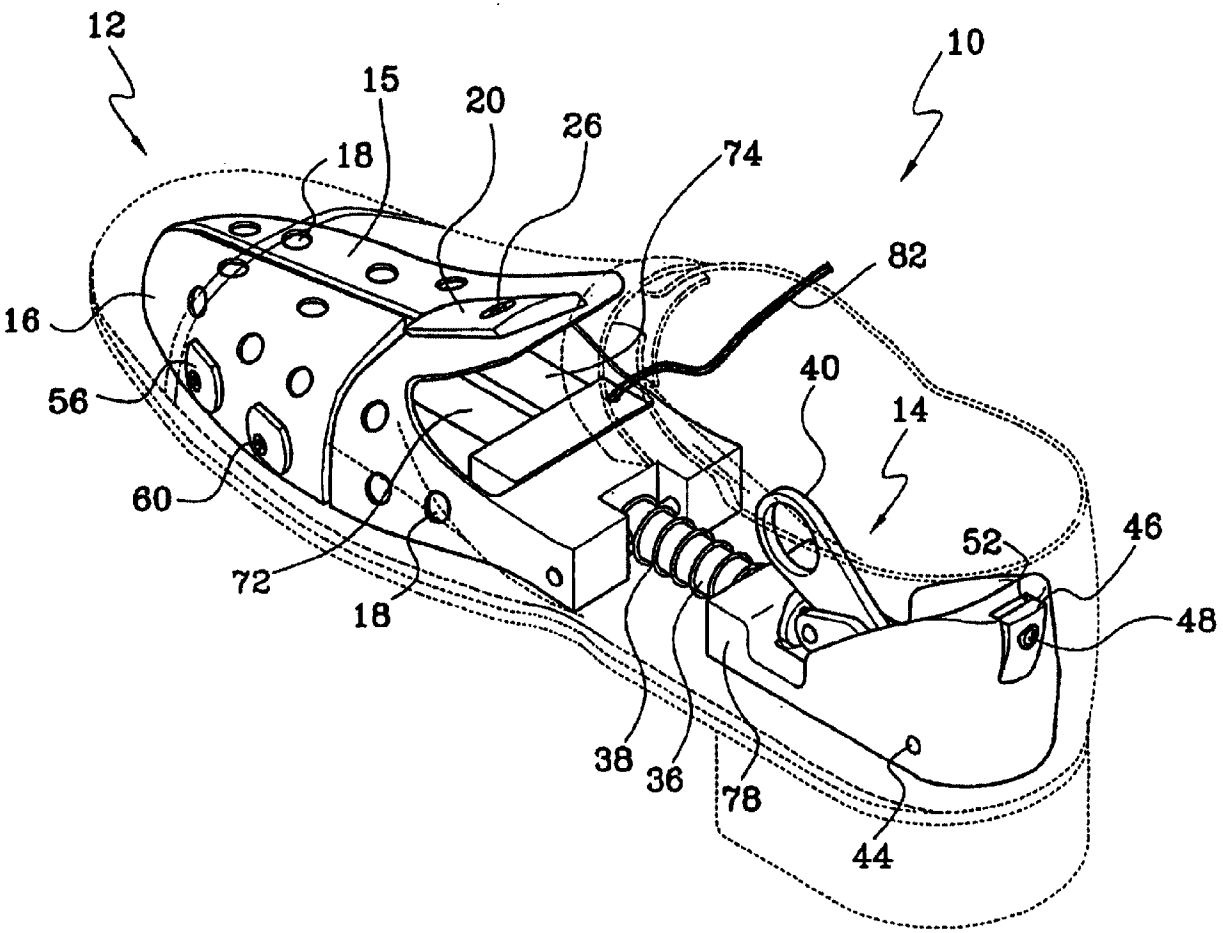
FIG. 5 shows an example in which the shoe corrector according to an embodiment of the present invention is used.

FIG. 5 shows an example in which the shoe corrector according to an embodiment of the present invention is used. The same reference numerals as the above represent the same element.

As shown in FIG. 5, an incandescent lamp 72 and an ultraviolet lamp 74 are provided within the front mold 12 installed in a shoe 70. As described above, since the front mold 12 includes a mold cavity, the incandescent lamp 72 and the ultraviolet lamp 74 can be installed. The incandescent lamp 72 and the ultraviolet lamp 74 are known in the art.

Basically, the incandescent lamp 72 emits light and heat to remove moisture from the shoe thereby making the inner area of the shoe dry. As described above, since the plurality of ventilating holes 18 are formed in the front mold 12, the heat produced from the incandescent lamp 72 emits through the ventilating holes 18 and thus evaporates the moisture within the shoe thereby making the inner area of the shoe dry. The incandescent lamp 72 and the ultraviolet lamp 74 may produce a glow by receiving external power through an electric wire or by receiving electricity from a battery installed within them.

Also, due to the incandescent lamp 72, the temperature of the corrector 10 itself rises slowly, which improves the correction effect of the shoe. Furthermore, ultraviolet rays produced from the ultraviolet lamp 74 are delivered to the inner area of the shoe through the ventilating holes 18 thereby eliminating germs within the shoe along with a bad smell and thus making the inner area clean.

The shoe corrector 10 according to this embodiment described above can be manufactured in various ways. For example, the shape of a wearer's foot may be input to a computer using a three-dimensional scanner, and in this case, the shoe corrector for the particular foot can be manufactured based on the input data. The shoe corrector can be manufactured using plaster casting as well.

Once a shoe corrector conforming to the foot of a user has been manufactured, in case of a new tough shoe, the shoe corrector is installed within the shoe before wearing it, which allows the wearer's foot to be accustomed to the shoe so that the shape of the shoe fits the shape of the foot.

While this invention has been particularly shown and described with reference to a preferred embodiment thereof, it will be understood by those skilled in the art that various changes in form and details may be made therein without departing from the spirit and scope of the invention as defined by the appended claims. The scope of the present invention may cover the configuration of the shoe corrector according to the present invention for correcting the shape of a shoe such that it completely fits a wearer's foot and making the inner area dry.

The shoe corrector according to the present invention described above allows each individual's foot to be accustomed to shoes which are mass produced with standardized dimensions thus providing more comfort to the wearer's foot. Furthermore, the shoe corrector prevents the shoe from deforming with long use. Also, since the shoe corrector having a cavity shape includes a plurality of ventilating holes, an incandescent lamp and an ultraviolet lamp can be disposed within the shoe corrector thereby evaporating the moisture in the shoe and killing various germs.

What is claimed is:

1. A shoe corrector installed within a shoe for stretching upper leather of the shoe so that the shape of the shoe fits a wearer's foot, the shoe corrector comprising:

a front mold for outwardly exerting elastic pressure on the upper leather in regions corresponding to the top side and the toe portion of the shoe;

a back mold disposed rearwardly of the front mold for outwardly exerting elastic pressure on the upper leather in a region corresponding to the heel portion of the shoe; and a length controller connecting the front mold with the back mold for adjusting the distance between the front and back molds;

wherein the front mold comprises:

a pressing plate which moves upward from an upper surface of the front mold;

elastic means for elastically supporting the pressing plate; and a control screw screwed to the front mold by penetrating the pressing plate for controlling an angle at which the pressing plate moves from the upper surface of the front mold; and wherein the pressing plate, the elastic means, and the control screw are disposed on the upper surface of the front mold for upwardly exerting pressure on the upper leather in the region corresponding to the top side of the shoe.

2. The shoe corrector of claim 1, wherein a front portion of the front mold up to the pressing plate is vertically cut along a longitudinal direction of the front mold, and a spring is interposed between the cut sections so as to exert elastic pressure on the upper leather in a lateral direction.

3. A shoe corrector installed within a shoe for stretching upper leather of the shoe so that the shape of the shoe fits a wearer's foot, the shoe corrector comprising:

a front mold for outwardly exerting elastic pressure on the upper leather in regions corresponding to the top side and the toe portion of the shoe;

a back mold disposed rearwardly of the front mold for outwardly exerting elastic pressure on the upper leather in a region corresponding to the heel portion of the shoe; and a length controller connecting the front mold with the back mold for adjusting the distance between the front and back molds;

wherein the front mold comprises:

a plurality of receiving grooves disposed at sides of the front mold, wherein in each of said receiving grooves a female screw thread is formed;

a pressure member disposed within each of the receiving grooves;

elastic means for elastically supporting the pressure member; and a control screw screwed into the female screw thread by penetrating the pressure member for controlling the projection of the pressure member; and wherein the receiving groove, the pressure member, the elastic means, and the control screw are disposed at the sides of the front mod for outwardly exerting elastic pressure on the upper leather in the region corresponding to the toe portion of the shoe.

4. A shoe corrector installed within a shoe for stretching upper leather of the shoe so that the shape of the shoe fits a wearer's foot, the shoe corrector comprising:

a front mold for outwardly exerting elastic pressure on the upper leather in regions corresponding to the top side and the toe portion of the shoe;

a back mold disposed rearwardly of the front mold for outwardly exerting elastic pressure on the upper leather in a region corresponding to the heel portion of the shoe; and a length controller connecting the front mold with the back mold for adjusting the distance between the front and back molds;

wherein the back mold comprises:

a receiving groove disposed on an outer surface of a rear end of the back mold, wherein a female screw thread is formed in said receiving groove;

a pressing plate disposed in the receiving groove;

elastic means for elastically supporting the pressing plate in an outward direction; and a control screw screwed into the female screw thread by penetrating the pressing plate for controlling an angle at which the pressing plate moves from the outer surface of the back mold; and wherein the receiving groove, the pressing plate, the elastic means, and the control screw are disposed at the rear end of the back mold for outwardly exerting pressure on the upper leather in the region corresponding to the heel portion of the shoe.

* * * * *